US008025543B2

(12) United States Patent
Lin et al.

(10) Patent No.: US 8,025,543 B2
(45) Date of Patent: Sep. 27, 2011

(54) METHOD OF MANUFACTURING A PARTITION WALL STRUCTURE ON A PLASMA DISPLAY PANEL

(75) Inventors: Chu-Shan Lin, Hsinchu (TW); Bing-Ming Ho, Chiai Hsien (TW); Tzu-Pang Chiang, Taoyuan (TW)

(73) Assignee: Au Optronics Corporation, Hsinchu (TW)

( * ) Notice: Subject to any disclaimer, the term of this patent is extended or adjusted under 35 U.S.C. 154(b) by 297 days.

(21) Appl. No.: 11/953,729

(22) Filed: Dec. 10, 2007

(65) Prior Publication Data

US 2008/0102727 A1 May 1, 2008

Related U.S. Application Data

(62) Division of application No. 11/363,686, filed on Feb. 27, 2006, now Pat. No. 7,361,072.

(30) Foreign Application Priority Data

Jul. 14, 2000 (TW) ..... 89114082 A

(51) Int. Cl.
*H01J 17/49* (2006.01)

(52) U.S. Cl. ..... 445/24; 313/586

(58) Field of Classification Search ..... 445/24–25; 313/582–587

See application file for complete search history.

(56) References Cited

U.S. PATENT DOCUMENTS

| | | | | |
|---|---|---|---|---|
| 5,701,056 | A | 12/1997 | Shinohara | 313/584 |
| 5,853,446 | A * | 12/1998 | Carre et al. | 65/17.3 |
| 5,860,843 | A * | 1/1999 | Kasahara | 445/24 |
| 5,909,083 | A | 6/1999 | Asano et al. | 313/584 |
| 6,008,582 | A | 12/1999 | Asano et al. | 313/582 |
| 6,023,130 | A * | 2/2000 | Sakasegawa et al. | 313/582 |
| 6,249,264 | B1 | 6/2001 | Sano et al. | 345/60 |
| 6,313,579 | B1 | 11/2001 | Nakano et al. | 313/493 |
| 6,337,663 | B1 | 1/2002 | Chi-Ming | 343/702 |
| 6,380,678 | B1 | 4/2002 | Kim | 313/586 |
| 6,400,078 | B1 * | 6/2002 | Van Bommel et al. | 313/582 |
| 6,414,435 | B1 | 7/2002 | Akiba | 313/584 |
| 6,489,722 | B1 | 12/2002 | Yoshida et al. | 313/582 |
| 6,577,063 | B1 | 6/2003 | Hsu et al. | 313/586 |
| 6,670,755 | B2 | 12/2003 | Masuda et al. | 313/582 |
| 6,670,756 | B2 | 12/2003 | Lin et al. | 313/582 |
| 6,713,959 | B1 | 3/2004 | Toyoda et al. | 313/582 |
| 2002/0008470 | A1 * | 1/2002 | Uegaki et al. | 313/567 |
| 2004/0000873 | A1 | 1/2004 | Moon | 313/587 |

FOREIGN PATENT DOCUMENTS

| | | | |
|---|---|---|---|
| CN | 1243329 | A | 2/2000 |
| JP | 05028926 | A | 2/1993 |
| JP | 06176697 | A | 6/1994 |
| JP | 09326233 | A | 12/1997 |
| JP | 11317170 | A | 11/1999 |
| JP | 2001-118512 | A | 4/2001 |

* cited by examiner

*Primary Examiner* — Anne Hines

(74) *Attorney, Agent, or Firm* — Ladas & Parry, LLP

(57) ABSTRACT

A plasma display panel and the manufacturing method thereof. Forming partition wall structures on the back substrate of the paste display panel and forming the column-shaped protrusions at the positions corresponding to the cuts on the rib on the front substrate of the plasma display panel. The manufacturing process is simple and the alignment of the front and back substrate is easy. In addition, the size of the opening of the rib and the size of the cut can be easily adjusted according to the needs of the application during the manufacturing process.

7 Claims, 17 Drawing Sheets

METHOD OF MANUFACTURING A PARTITION WALL STRUCTURE ON A PLASMA DISPLAY PANEL

BACKGROUND OF THE INVENTION

1. Field of the Invention

The present invention relates to a plasma display panel and the manufacturing method thereof, more particularly to the partition wall structure of the panel and the manufacturing method thereof.

2. Description of the Prior Art

The rib of the plasma display panel (referred to PDP in the following) commonly has a stripe-shaped structure. However, the grid-mesh rib structure is also used at present, for example, the one disclosed in the U.S. Pat. No. 5,701,056 by NEC. The structure disclosed by NEC forms stripe-shaped ribs on the back substrate of the PDP and forms grid-mesh-shaped ribs on the front substrate of the PDP, then assembles the front and back substrates, as shown in FIG. 1. The structure disclosed by NEC has the following four disadvantages:

Since the front substrate has an additional rib manufacturing process in the NEC structure, the cost is relatively high.

When assembling the front and the back substrates, the high aligning precision of the two substrates is strictly required; this deepens the difficulty of the manufacturing process.

To ensure that the front and the back substrate are precisely aligned, increasing the width of the rib of the front and the back substrates is often required. Hence the opening rate of the PDP is compromised.

Due to the width of the rib, the effective area of the coating fluorescent body becomes smaller.

SUMMARY OF THE INVENTION

One object of the present invention is to provide the structure of a plasma display panel and the manufacturing method thereof; the manufacturing method of the partition wall structure of the present invention is easy and can overcome the problems encountered by NEC.

Another object of the present invention is to provide the manufacturing method of the partition wall structure of the PDP, and defines the size of cut of the partition wall structure required by using simple procedures.

The plasma display panel disclosed in the present invention includes: a first substrate (back substrate); a second substrate (front substrate), disposed parallel to the first substrate, so as to form a discharging space between the first substrate and the second substrate. There forms a gird-mesh-shaped rib on the first substrate; there are a plurality of column-shaped protrusions and an air-pump hole for exhaust formed on the second substrate.

The partition wall structure on the first substrate includes:

A plurality of first stripe ribs, the plurality of the first stripe ribs defines the discharging space to become the plurality of the row discharging space;

A plurality of second stripe ribs, each of the second stripe ribs crosses each of the first stripe ribs with cuts in every row of discharging space so that gas can flow through the row of discharging space through the cut.

The plurality of the column-shaped protrusions formed on the second substrate, wherein the protrusions dispose above the cuts of the first ribs on the first substrate, the height of the column-shaped protrusions is $H_2$, which is less than the height of the cut 306, $H_1$.

The manufacturing method of the plasma display panel includes:

(1) Providing the first substrate, the first substrate has an air-pump hole.

(2) Forming a plurality of the stripe-shaped electrodes on the first substrate, each stripe-shaped electrode is substantially parallel to a first direction.

(3) Forming an overcoat layer on the stripe-shaped electrodes and the first substrate.

(4) Forming a second substrate, the second substrate and the first substrate are parallel; a discharging space is formed between the first substrate and the second substrate, wherein the discharging space connects with the air-pump hole.

(5) Forming a partition wall structure on the first substrate, the partition wall structure includes a plurality of first stripe ribs and a plurality of second stripe ribs, the plurality of the first stripe ribs defines the discharging space to form a plurality of row discharging space, each of the second stripe ribs crosses each of the first stripe ribs; and in every row discharging space, each second stripe rib has a cut, the depth of the cut of the second stripe rib is $H_1$, so that gas can flow through the row discharging space through the cuts.

(6) Forming a plurality of column-shaped protrusions on the second substrate, the column-shaped protrusions form at positions corresponding to the cuts of the second stripe ribs on the first substrate, the column-shaped protrusions have a protrusion height $H_2$, which is less than the depth of the cuts of the second stripe ribs on the first substrate, $H_1$.

(7) Combining the edge of the first substrate and the edge of the second substrate to seal the discharging space, so that the column-shaped protrusions of the second substrate embed into the cuts of the second stripe ribs on the first substrate, and leaves a channel of gas through the cut so that gas can flow through the row discharging space through the channel.

(8) Pumping the air within the plasma display panel through the air-pump hole for the discharging space, so that the gas in the row discharging space can be pumped out of the discharging space through the channel.

According to the present invention, there are four following manufacturing methods for forming the partition wall structures of the first substrate (back substrate).

The first method of manufacturing ribs according to the present invention includes the following steps.

(a) Firstly, providing a substrate, on which forms a plurality of stripe-shaped electrodes. Each of the stripe-shaped electrodes is parallel to a first direction.

(b) Forming an overcoat layer on the stripe-shaped electrodes and the substrate.

(c) Forming a shaping layer on the overcoat layer, the shaping layer including a plurality of stripe-shaped protrusions formed above the overcoat layer, each of the protrusions is disposed between two stripe-shaped electrodes, and is parallel to the first direction.

(d) Next, forming a photoresist layer, such dry photoresist film, on the shaping layer.

(e) Exposing the dry photoresist layer to form a shading mask on the shaping layer; the shading mask includes a plurality of first stripe regions and a plurality of second stripe regions; each first stripe region is formed on each of the stripe-shaped protrusions; each of the second stripe regions is parallel to a second direction and substantially perpendicular to the first direction.

(f) Finally, perform a sand-spreading process to remove the shaping layer not covered by the shading mask to expose certain portion of the overcoat layer and form the partition wall structure.

The second method of manufacturing the rib according to the present invention includes the following steps.

(a) First, providing a substrate; a plurality of stripe-shaped electrodes are formed on the substrate; each of the stripe-shaped electrodes is parallel to a first direction.

(b) Forming an overcoat layer on the stripe-shaped electrodes and substrate.

(c) Using pattern print process to form the shaping layer of the mesh-grids rib on the overcoat layer. The shaping layer include a plurality of first stripe ribs, and a plurality of second stripe ribs; each of the first stripe rib is disposed between every two stripe-shaped electrodes, and is parallel to the first direction; each of the second stripe ribs is parallel to a second direction and is substantially perpendicular to the first direction.

(d) Finally, using pattern print process to form a plurality of third stripe ribs on the shaping layer. Each of the third stripe layers is formed on each of the first stripe layers thereby forming a partition wall structure.

The third method of manufacturing ribs according to the present invention includes the following steps.

(a) First, providing a substrate. A plurality of stripe-shaped electrodes are formed on the substrate, each of the stripe-shaped electrodes is parallel to the first direction.

(b) Forming an overcoat layer on a plurality of stripe-shaped electrodes and substrates.

(c) Forming a shaping layer on the overcoat layer.

(d) Forming a photoresist layer on the shaping layer.

(e) Exposing the dry photoresist layer to form a shading mask on the shaping layer. The shading mask includes a plurality of first stripe-shaped ribs and a plurality of second stripe-shaped ribs; each of the first stripe-shaped ribs is parallel to the first direction and is disposed between every two stripe-shaped electrodes; each of the second stripe-shaped ribs is parallel to a second direction and is substantially perpendicular to the first stripe-shaped ribs; there are cuts regions at the crossed regions of the second stripe-shaped ribs and the stripe-shaped electrodes to expose the shaping rib.

(f) Finally, performing the sand-spreading process to remove the shaping layer not covered by the shading mask to expose certain portion of the overcoat layer to form the partition wall structure. There still remains a shaping layer on the cuts regions.

The fourth method of manufacturing the rib according to the present invention includes the following steps.

(a) First, providing a substrate. A plurality of stripe-shaped electrodes are formed on the substrate, each of the stripe-shaped electrodes is parallel to a first direction.

(b) Forming an overcoat layer on the stripe-shaped electrodes and the substrate.

(c) Forming a shaping layer on the overcoat layer.

(d) Forming a photo-sensing shading layer in grid-mesh shape on the shaping layer. The photo-sensing shading layer includes a plurality of first stripe ribs and a plurality of second stripe ribs; each of the first stripe ribs is disposed between every two stripe-shaped electrodes, and is parallel to the first direction; each of the second stripe ribs is parallel to a second direction and is substantially perpendicular to the first direction; wherein the height of the first stripe rib is larger than the height of the second stripe rib.

(e) Exposing and developing the photo-sensing shading layer to form a shading mask on the shaping layer.

(f) Finally, performing the sand-spreading process to remove the shaping layer not covered by the shading mask to expose certain portion of the overcoat layer to form the partition wall structure.

BRIEF DESCRIPTION OF DRAWINGS

The following detailed description, given by way of example and not intended to limit the invention solely to the embodiments described herein, will best be understood in conjunction with the accompanying drawings, in which:

FIG. 3A is assembled;

EMBODIMENTS

Figure 3A:
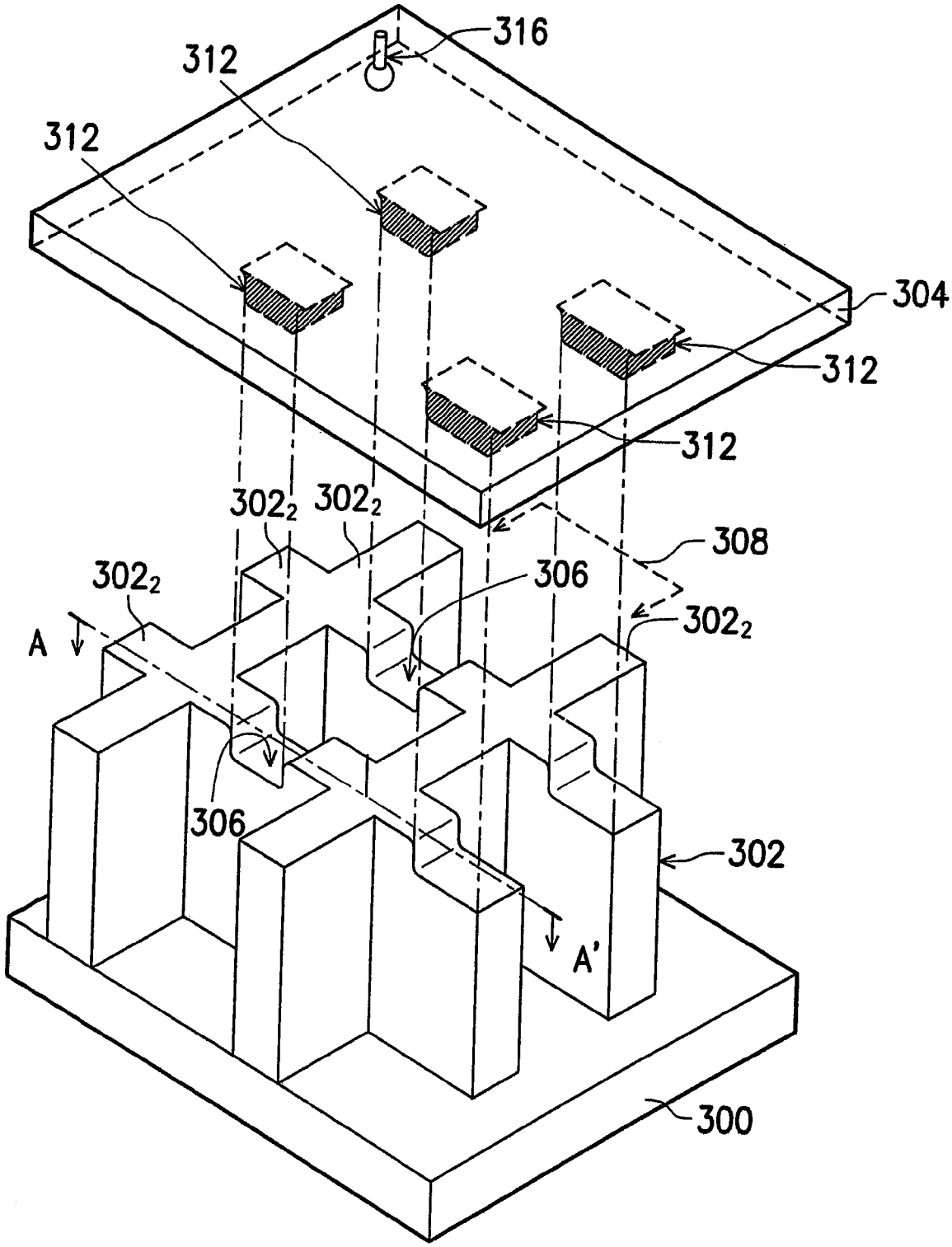
FIG. 3A shows the schematic diagram of the assembly of partial structure of the front and back substrates of PDP of the present invention.
Figure 3B:
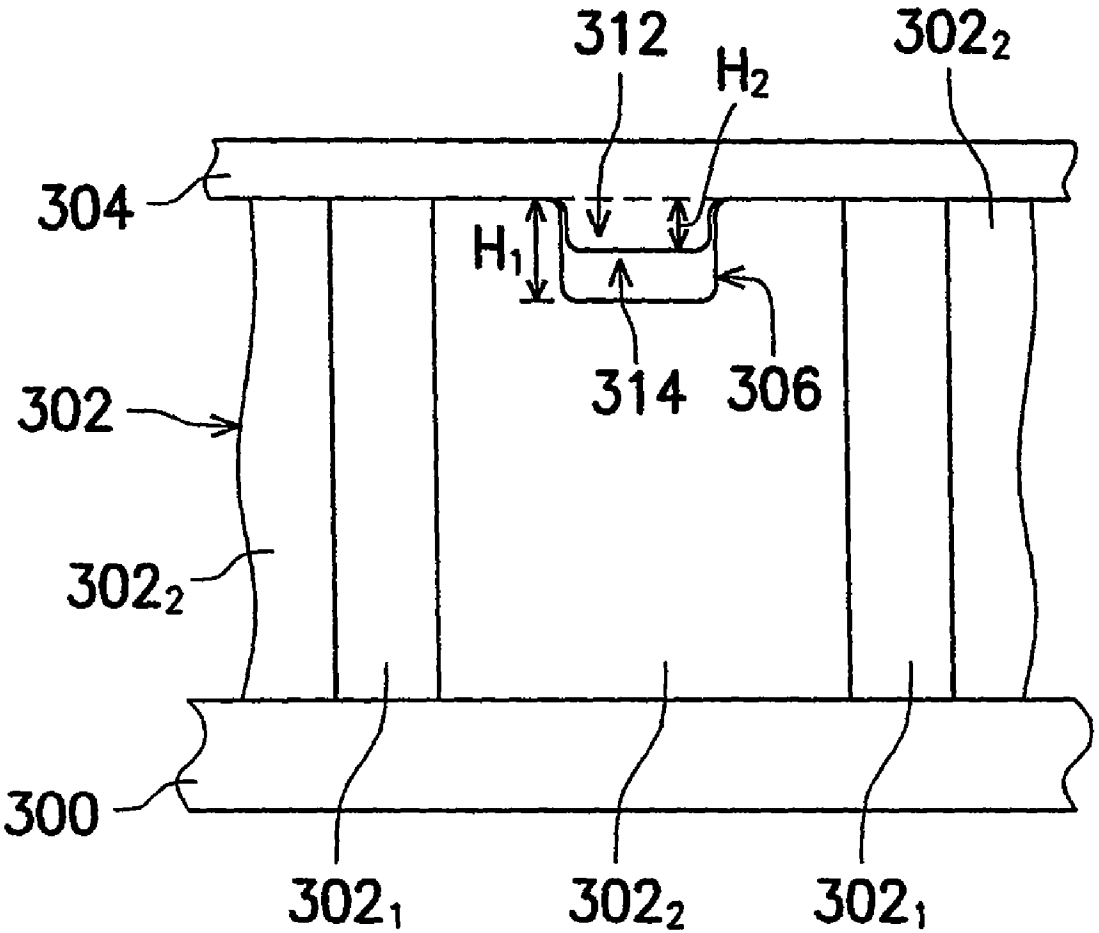
FIG. 3B shows the cross-section along A-A' after

FIG. 3A shows the schematic diagram of the assembly of partial structure of the front and back substrates of PDP. FIG. 3B shows the cross-sectional view along A-A' after FIG. 3A is assembled.

Refer to FIGS. 3A and 3B, the plasma display panel disclosed by the present invention includes a first substrate 300 and a second substrate 304 parallel to the first substrate 300, thereby forming a discharging space between the first substrate 300 and the second substrate 304. A partition wall structure is formed on the first substrate and a plurality of column-shaped protrusions 312 on the second substrate 304, and an air-pump hole 316 formed on the second substrate.

The partition wall structure 302 on the first substrate includes a plurality of first stripe ribs $\mathbf{302}_1$ and a plurality of second stripe ribs $\mathbf{302}_2$, the plurality of first stripe ribs $\mathbf{302}_1$ define the discharging space to become a plurality of row discharging space 308; each of the second stripe ribs $\mathbf{302}_2$, crosses each of the first stripe ribs $\mathbf{302}_1$, in every row discharging space 308, each of the second stripe ribs $\mathbf{302}_2$ has a cut 306 so that gas can flow through the row discharging space through the cut 306.

The plurality of column-shaped protrusions 312 on the second substrate is formed at the positions corresponding to the cuts on the first substrate; and the height of the column-shaped protrusions, $H_2$ is smaller than the depth of the cuts, $H_1$.

Therefore (refer to FIG. 3B), when the first substrate 300 and the second substrate 304 combine, the column-shaped protrusions 312 on the second substrate 304 embeds into the cuts 306 of the first substrate 300 and there will be a channel 314 in the cut 306 so that gas can flow through the row discharging space through channel 314.

The manufacturing method of the plasma display panel provided by the present invention includes the following steps:

(1) Providing a first substrate 300, which has an air-pump hole 316 on the first substrate 300.

(2) Forming a plurality of stripe-shaped electrodes (not shown in FIG. 3A to 3B) on the first substrate, each of the stripe-shaped electrodes is parallel to a first direction.

(3) Forming an overcoat layer (not shown in FIG. 3A to 3B) on the stripe-shaped electrodes and the first substrate 300.

(4) Providing a second substrate 304, the second substrate is parallel to the first substrate; there forms a discharging space between the first substrate and the second substrate, wherein the discharging space connects the air-pump hole.

(5) Forming a partition wall structure 302 on the first substrate 300, the partition wall structure 302 includes a plurality of first tripe ribs $\mathbf{302}_1$ and a plurality of second stripe ribs $\mathbf{302}_2$, the plurality of the first stripe ribs $\mathbf{302}_1$ defines the discharging space to become a plurality of row discharging spaces 308, each of the second stripe ribs $\mathbf{302}_2$ crosses each of the first stripe ribs $\mathbf{302}_1$; and in every row discharging space 308, each of the second stripe ribs $\mathbf{302}_2$ has a cut 306, the cut 306 of the second stripe ribs $\mathbf{302}_2$ has a cut depth of $H_1$ so that gas flows through the row discharging space 308 through the cuts 306.

(6) Forming a plurality of column-shaped protrusions 312 on the second substrate 304, the column-shaped protrusions 312 are formed at positions corresponding to the cuts 306 of the first substrate 300, the column-shaped protrusions 312 have heights of $H_2$, the height $H_2$ is smaller than the cut height $H_1$.

(7) Combining the edge of the first substrate 300 and the edge of the second substrate 304 to conceal the discharging space so that the column-shaped protrusions 312 on the second substrate 304 embed into the cuts 306 of the first substrate, leaving a channel 314 in the cut 306 so that gas can flow through the row discharging space through the channel 314.

(8) Pumping air out of the discharging space through the air-pump hole 316, so that the gas in the row discharging space 308 is pumped out from the air-pump hole 316 through the channel 314 out of the discharging space.

The manufacturing process of the column-shaped protrusions 312 can be: before coating the surface protective layer (MgO) on the second substrate 304, using mesh-printing process or photolithography to form column-shaped protruding objects on the second substrate 304 semi-product surface; after coating the MgO, the column-shaped protrusions 312 is formed at the positions of the protruding objects corresponding to the cuts 306.

In this embodiment, the individual pixel discharging space is isolated by first stripe ribs $\mathbf{302}_1$ and second stripe ribs $\mathbf{302}_2$. Only channel 314 connects to the individual pixel discharging space belonging to the same row discharging space 308. Due to the limitations of height $H_2$ of the column-shaped protrusions, the distance between channel 314 and the front substrate 304 is at least $H_2$. Since the place closed to the surface of the front substrate 304 by the individual discharging space is isolated by column-shaped protrusion 312, the cross-talk between different pixels when front substrate X-Y electrode drives gas back and forth during the driving signal sustain period is reduced. However, the protrusions can be eliminated, and individual pixels can also be isolated by the first stripe rib $\mathbf{302}_1$ or the second stripe $\mathbf{302}_2$, the cross-talk between different pixels can also be reduced.

There are four following manufacturing methods in forming grid-mesh shaped ribs on the first substrate (back substrate).

[First Method]

FIGS. 2A to 2E show the 3-D cross-sectional flow charts of the manufacturing method of the partition wall structure according to the present invention.

First, a substrate is provided. A plurality of stripe electrodes 202 is formed on the substrate. Each of the stripe electrodes is parallel to a first direction (shown by arrow D). To simplify the description in this embodiment, only two stripe electrodes are shown.

Figure 1:
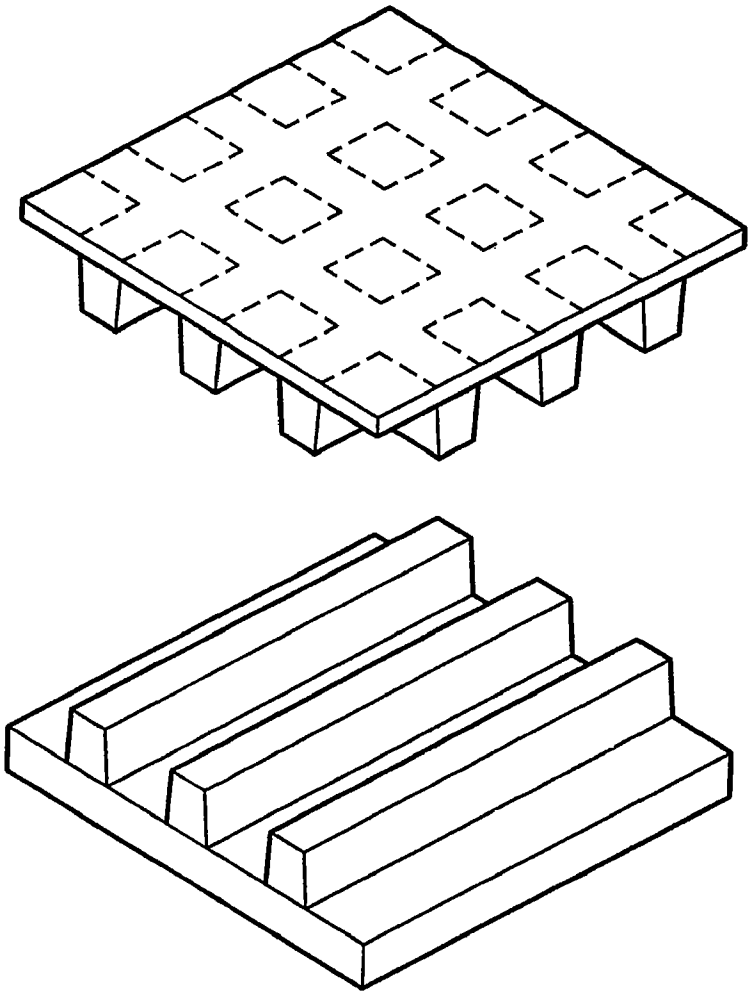
FIG. 1 shows the structure diagram of the PDP rib disclosed by NEC.
Figure 2A:
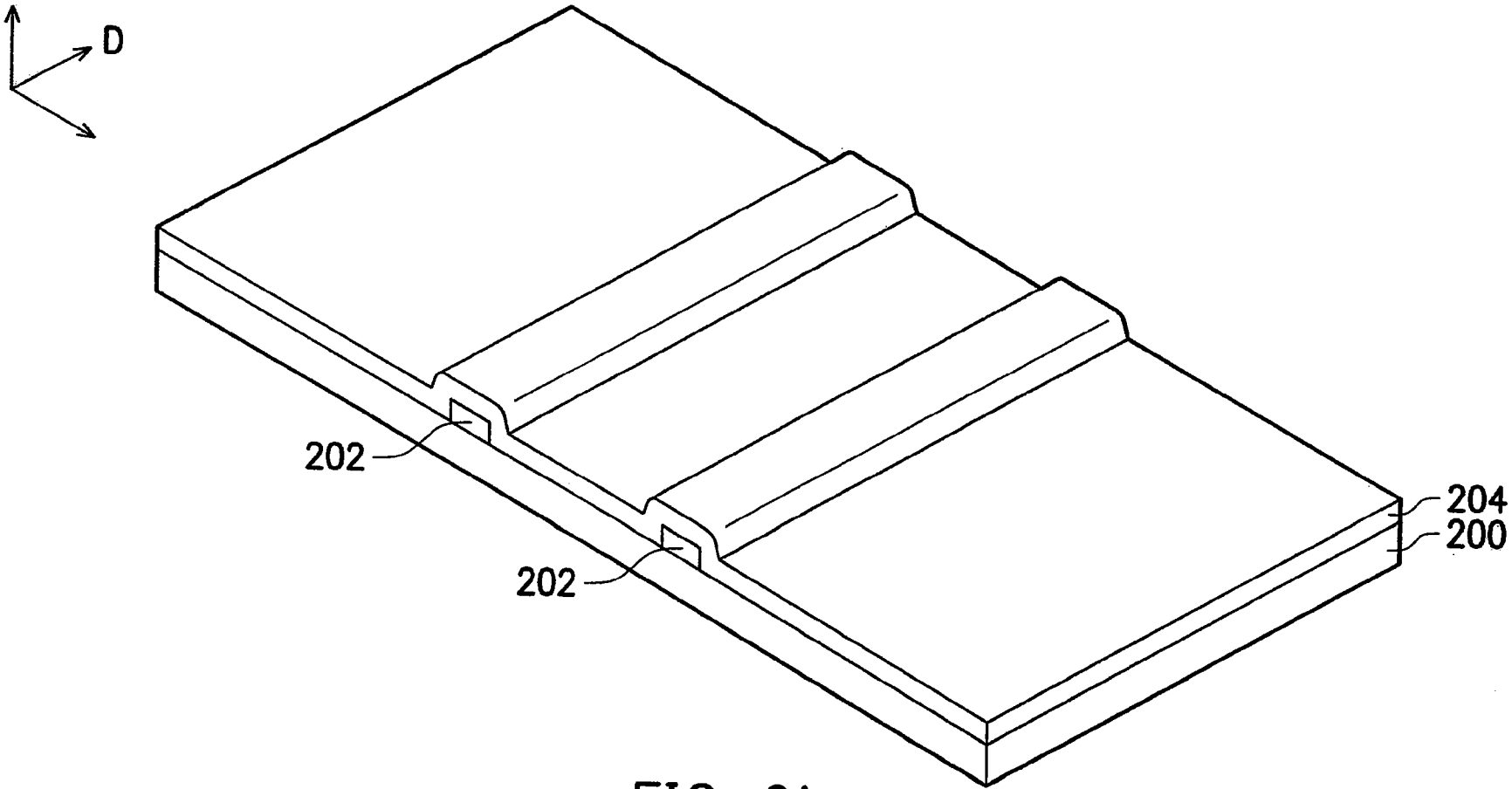
FIGS. 2A to 2E show the 3-D cross-sectional flow charts of the first method of forming a partition wall structure.

Next, an overcoat layer 204 is formed on the stripe electrodes 202 and the substrate 200 as shown in FIG. 2A.

Next, a shaping layer 206 is formed on the overcoat 204. The surface of the shaping layer includes a plurality of stripe protrusions 206*a*; each of the protrusions 206*a* is at the center of every two stripe electrodes 202 and is substantially parallel to the first direction.

Figure 2B:
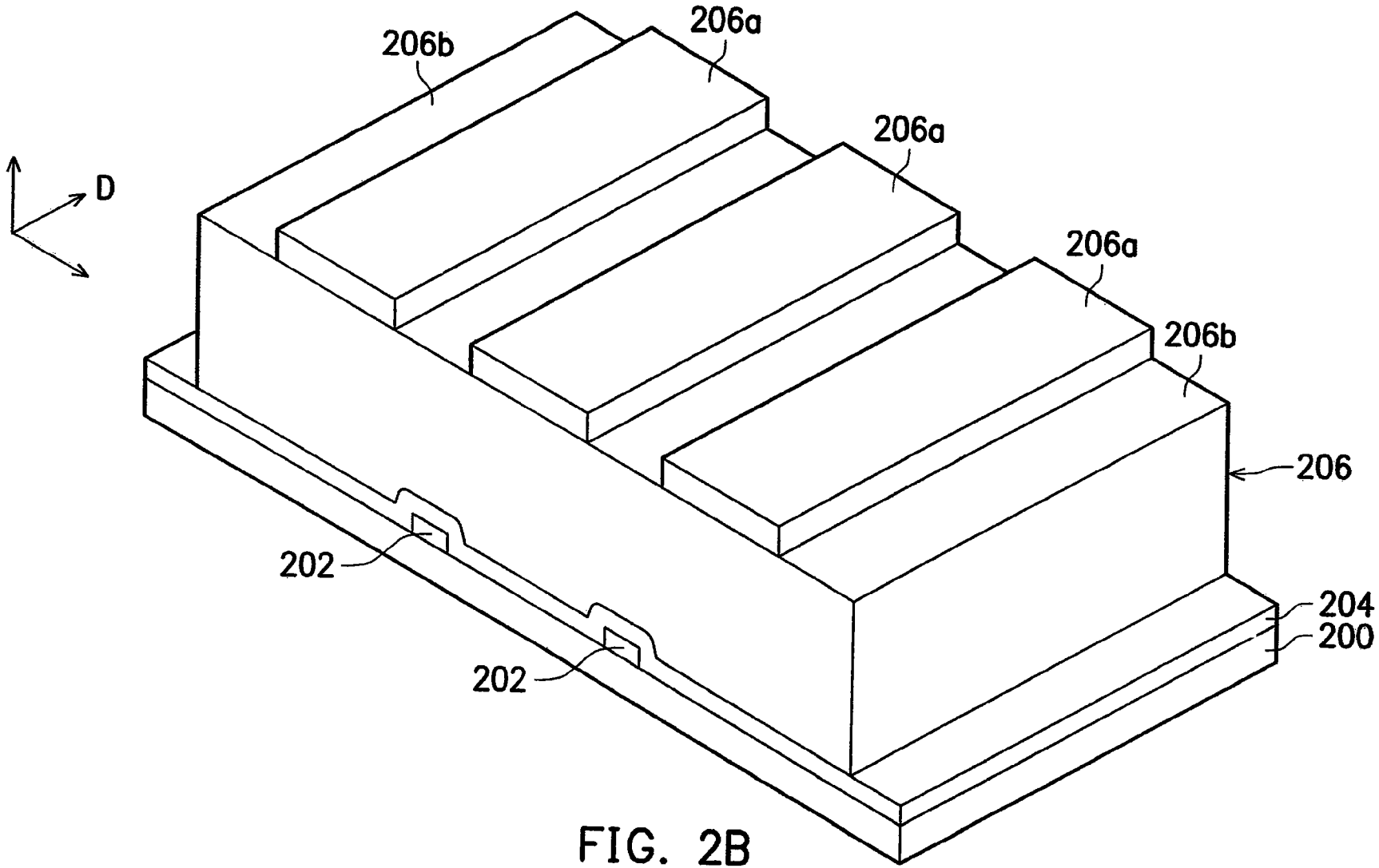

In this embodiment, the shaping layer 206 of FIG. 2B has the two following manufacturing methods.

(1) First method: print multi-layers (for example 7~8 layers) of paste on the overcoat layer 204 using full print, forming flat-top 206*b* after baking. Next, print 1~3 layers of paste using pattern print, forming the stripe protrusions 206*a* after baking.

(2) Second method: print 1~3 layers of paste with pattern print; forming a plurality of stripe protrusion regions along the first direction after baking as the bottom of the stripe protrusion 206*a*.

Perform full print, print multi-layers (for example 7~8 layers) of paste on overcoat layer 204 and stripe protrusion regions, forming a shaping layer as shown in FIG. 2B after baking.

After forming the shaping layer 206, form a dry photoresist layer on the shaping layer.

Figure 2C:
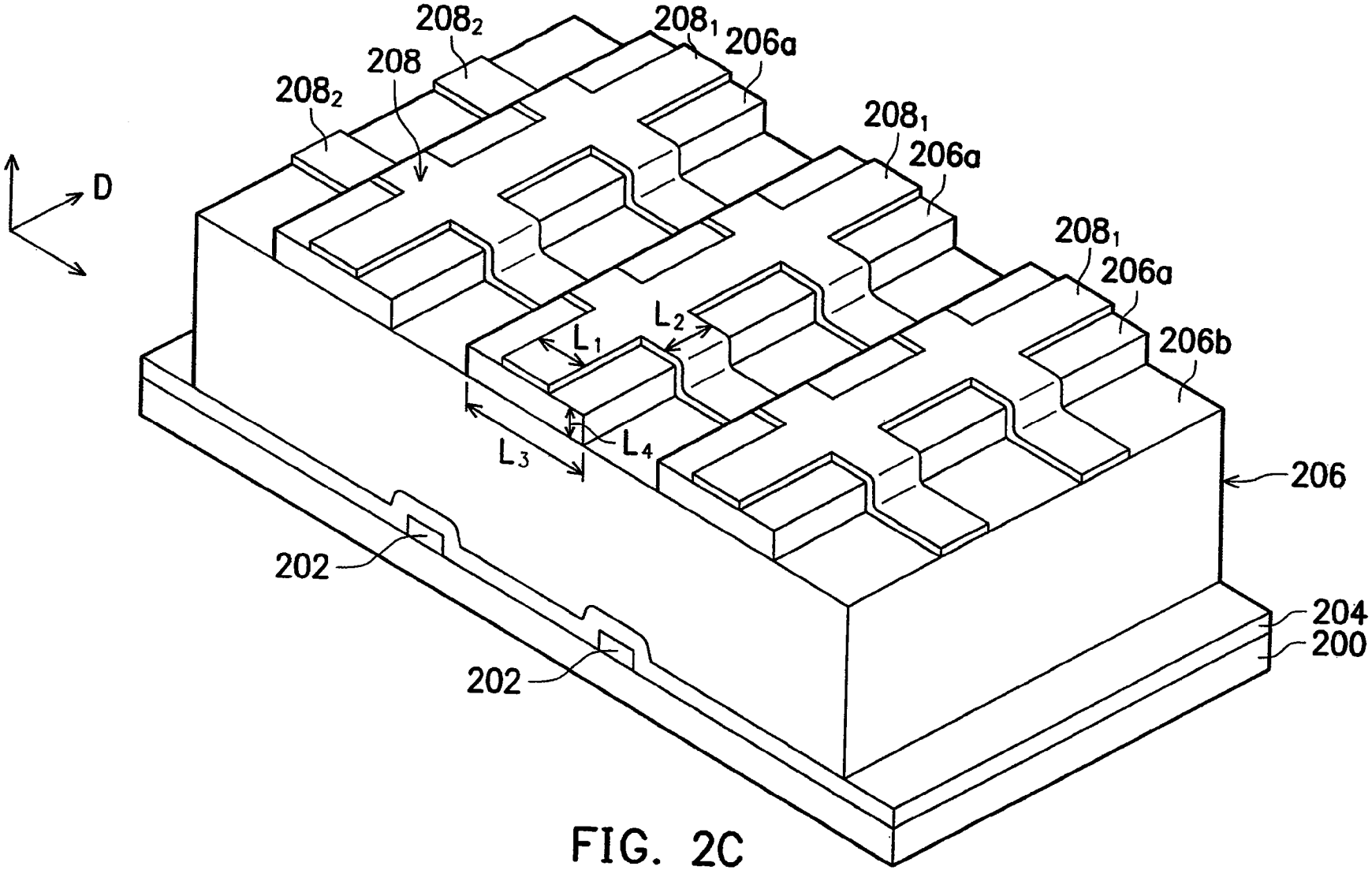

Next, expose and developing the dry photoresist layer to form the shading mask 208 on the shaping layer 206. The shading mask 208 as shown in FIG. 2C has the grid-mesh structure, the shading mask 208 includes a plurality of first stripe ribs $\mathbf{208}_1$ and a plurality of second stripe ribs $\mathbf{208}_2$; each of the first stripe ribs $\mathbf{208}_1$ is parallel to the first direction and forms on a stripe protrusion 206*a*; each of the second stripe ribs $\mathbf{208}_2$ is substantially perpendicular to the first direction and forms on the plurality of stripe protrusions 206*a* and flat-top 206*b*.

Figure 2D:
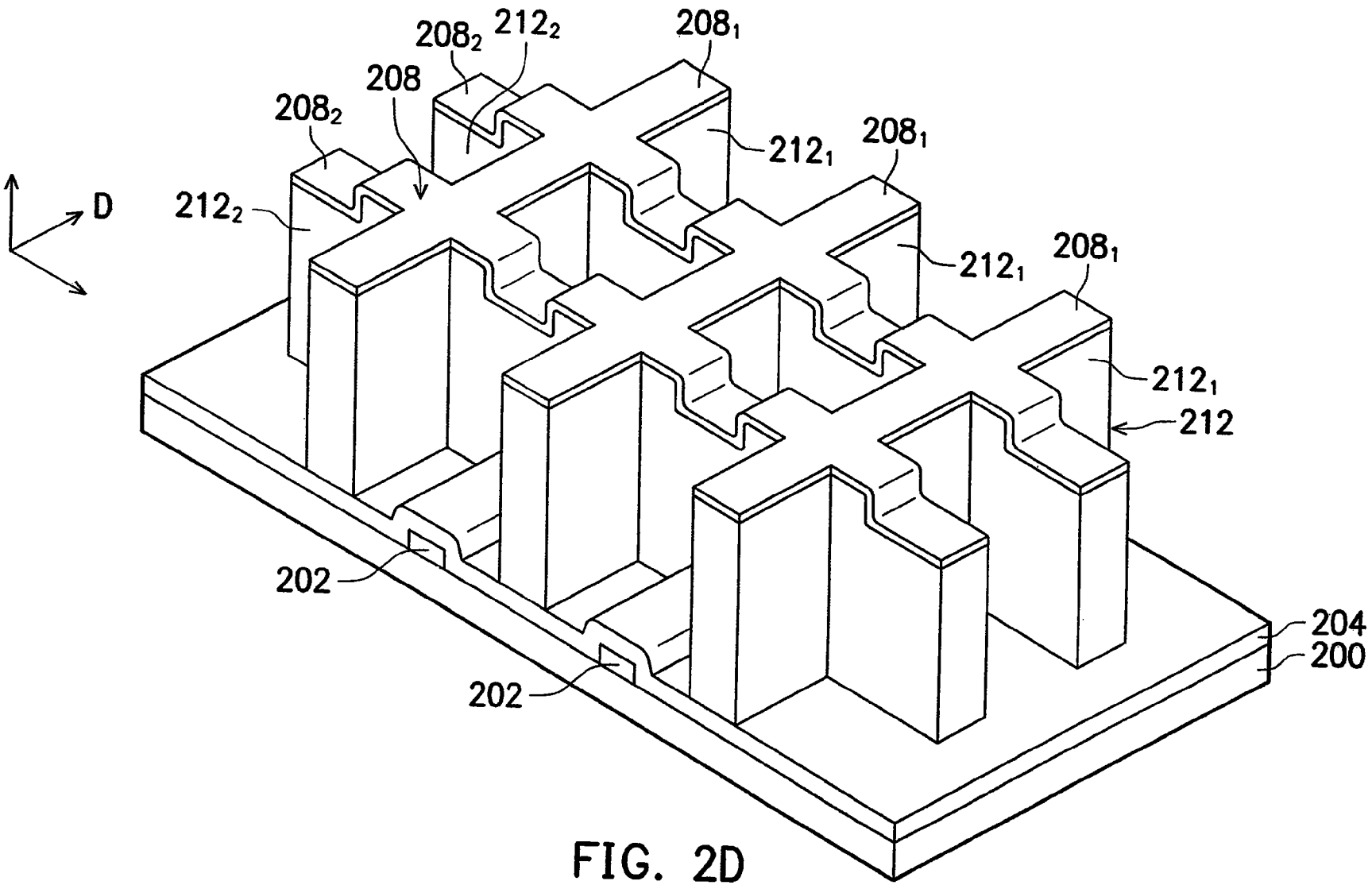

Perform the sand blast process; remove the shaping layer 206 which is not covered by the shading mask 208 until the overcoat layer 204 is exposed to form grid-mesh shaped rib 212 (includes: a plurality of first stripe ribs $\mathbf{212}_1$ and a plurality of second stripe ribs $\mathbf{212}_2$) as shown in FIG. 2D.

Figure 2E:
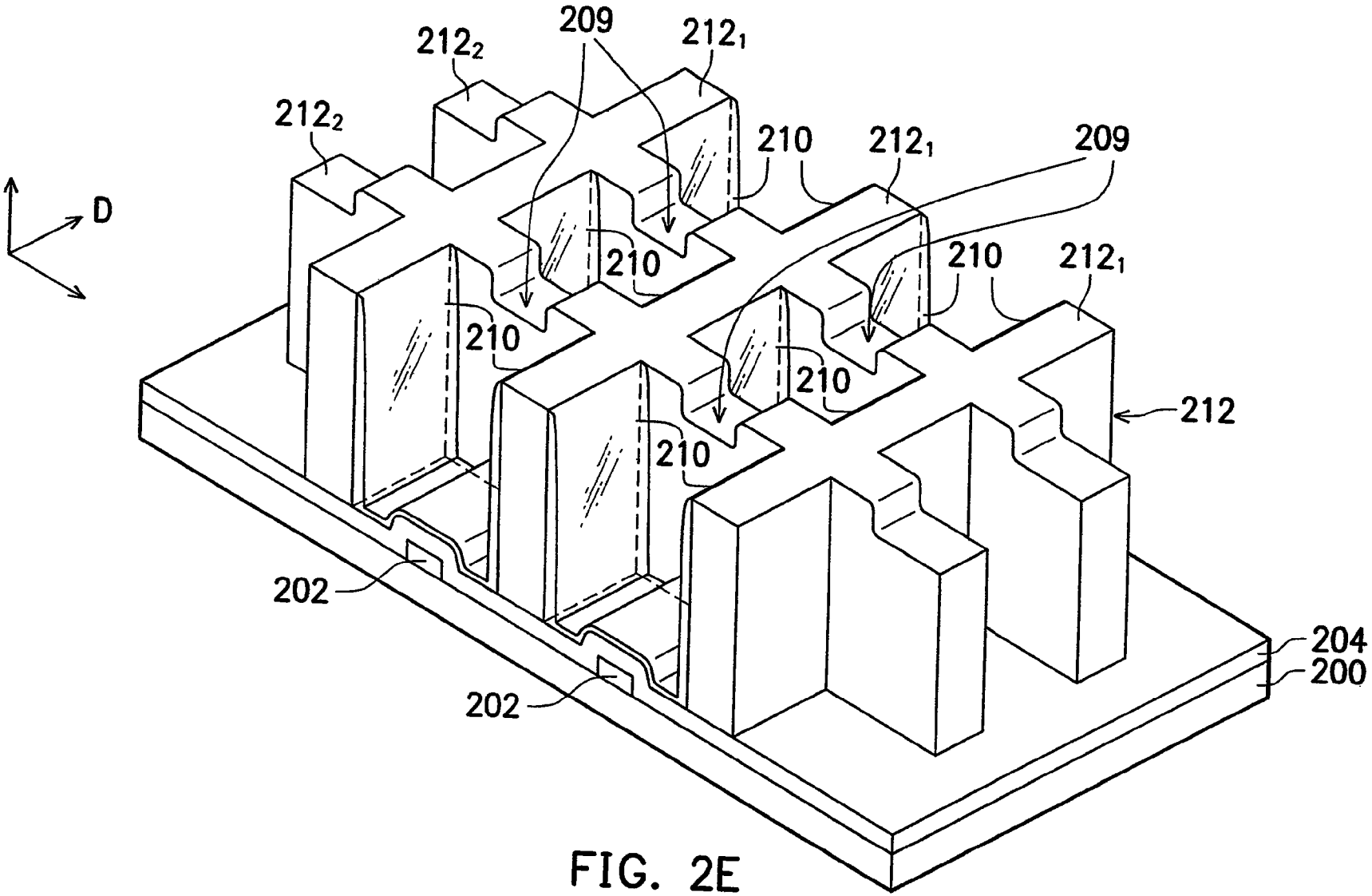

After forming the rib, the shading mask 208 (i.e., the dry photoresist layer after exposure) is removed, then fluorescent body 210 is printed to form back substrate of PDP as shown in FIG. 2E. It should be noted that there are cuts 209 on each of the second stripe ribs $\mathbf{212}_2$ of the rib 212.

Finally, assemble the back substrate and the front substrate, and then perform the subsequent process.

According to the method of the present invention, and referring to FIGS. 2C and 2E, varying the width $L_1$ of the first stripe ribs $\mathbf{208}_1$ and the width $L_2$ of the second stripe ribs $\mathbf{208}_2$ can adjust the thickness of the rib so to influence the effective size of the pixel to obtain an adequate opening ratio.

Further, refer to FIGS. 2C and 2E, varying the width $L_3$ and height $L_4$ of the flat-top 206*b* of the shaping layer 206 can control the width and depth of the cuts 209.

[Second Method]

Figure 4A:
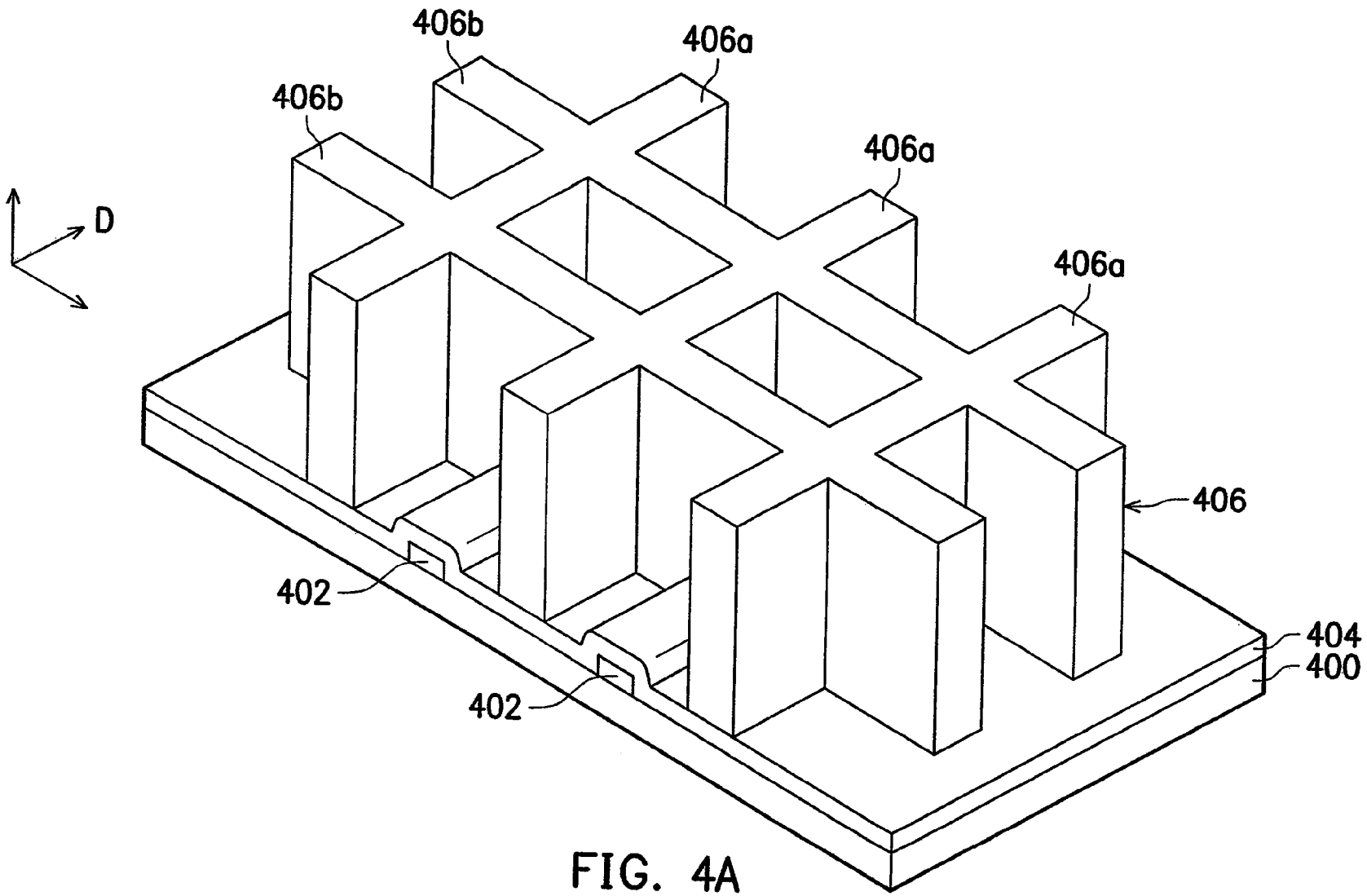
FIGS. 4A to 4B show 3-D cross-sectional flow charts of the second method of forming a partition wall structure.
Figure 4B:
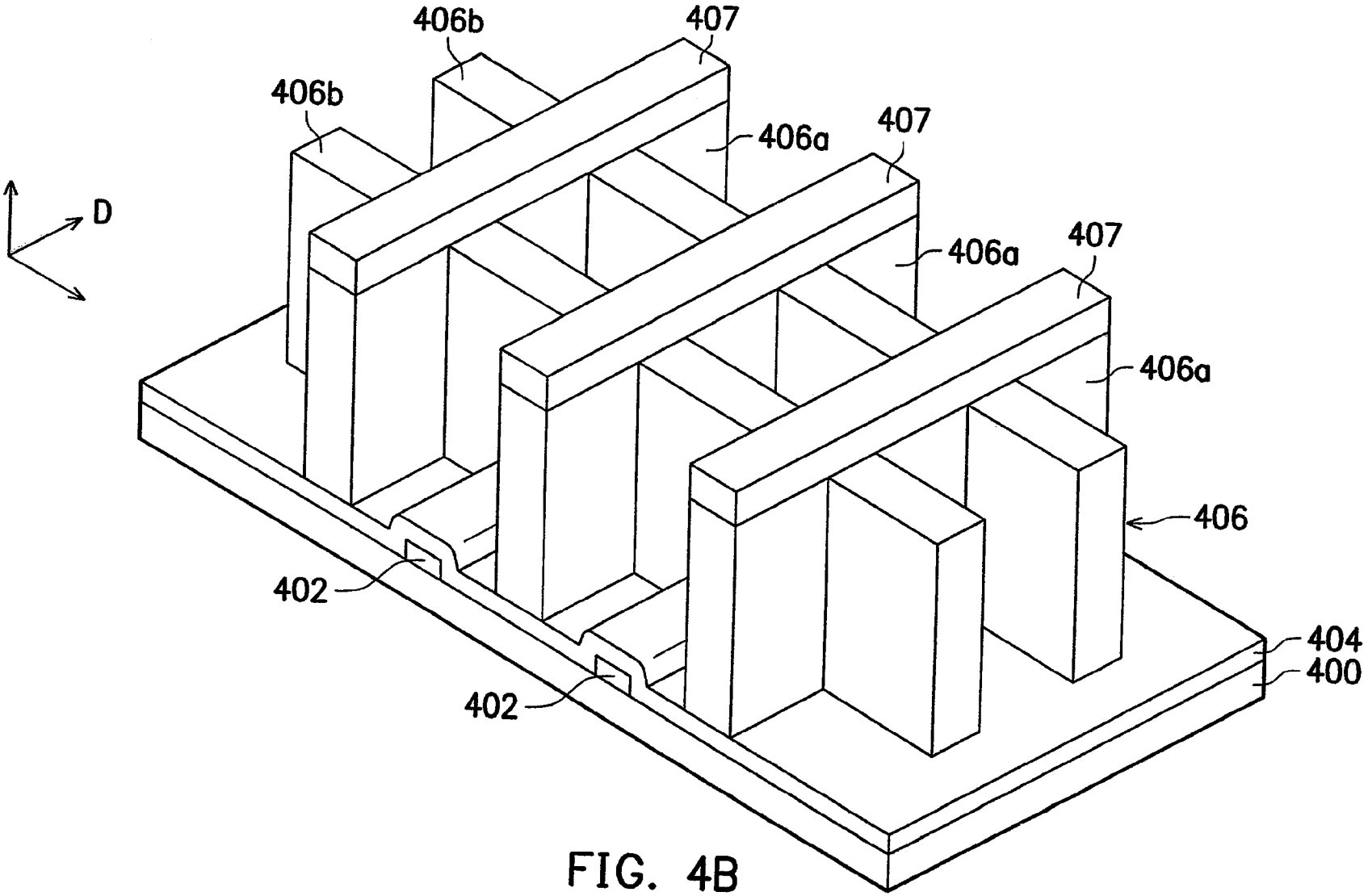

FIGS. 4A to 4B show the 3-D cross-sectional flow chart of the second manufacturing method of the grid-mesh shaped rib.

First, a substrate 400 is provided. There forms a plurality of stripe electrodes 402 on the substrate 400. Each of the stripe electrodes 402 is parallel to a first direction (shown by arrow D). To simplify the description of this embodiment, only two stripe electrodes are shown.

Form an overcoat layer 404 on the stripe electrodes 402 and the substrate 400.

Next, form a grid-mesh-shaped shaping layer 406 on the overcoat layer 404 with pattern print to form the partition wall structure of PDP. As shown in FIG. 4A, the shaping layer 406 includes a plurality of first stripe ribs 406*a* and a plurality of second stripe ribs 406*b*. Each of the stripe ribs 406*a* is disposed between every two stripe electrodes 402, and is parallel to the first direction. Each of the second stripe ribs 406*b* is parallel to a second direction and substantially perpendicular to the first direction and crosses with the plurality of the stripe electrodes 402.

Furthermore, print multi-layers (for example 7~8 layers) of paste on the overcoat layer 404 with pattern print to form the shaping layer after baking. Since the height of the plurality of the stripe electrodes is lower, after pattern print multi-layers, the top of the second stripe ribs 406*b* of the shaping layer is an even surface.

Finally, a plurality of the third stripe ribs 407 is formed on the first stripe ribs 406*a* with pattern print. After baking, the third stripe ribs 407 become the top wall of the first stripe ribs 406*a*. Every two third stripe ribs 407 and any second stripe rib 406*b* constitute a cut so that when the front and back substrates assemble, gas can flow through row discharging space through the cuts.

The third stripe ribs 407 are formed by printing multi-layers of paste with pattern print and then baked.

[Third Method]

Figure 5A:
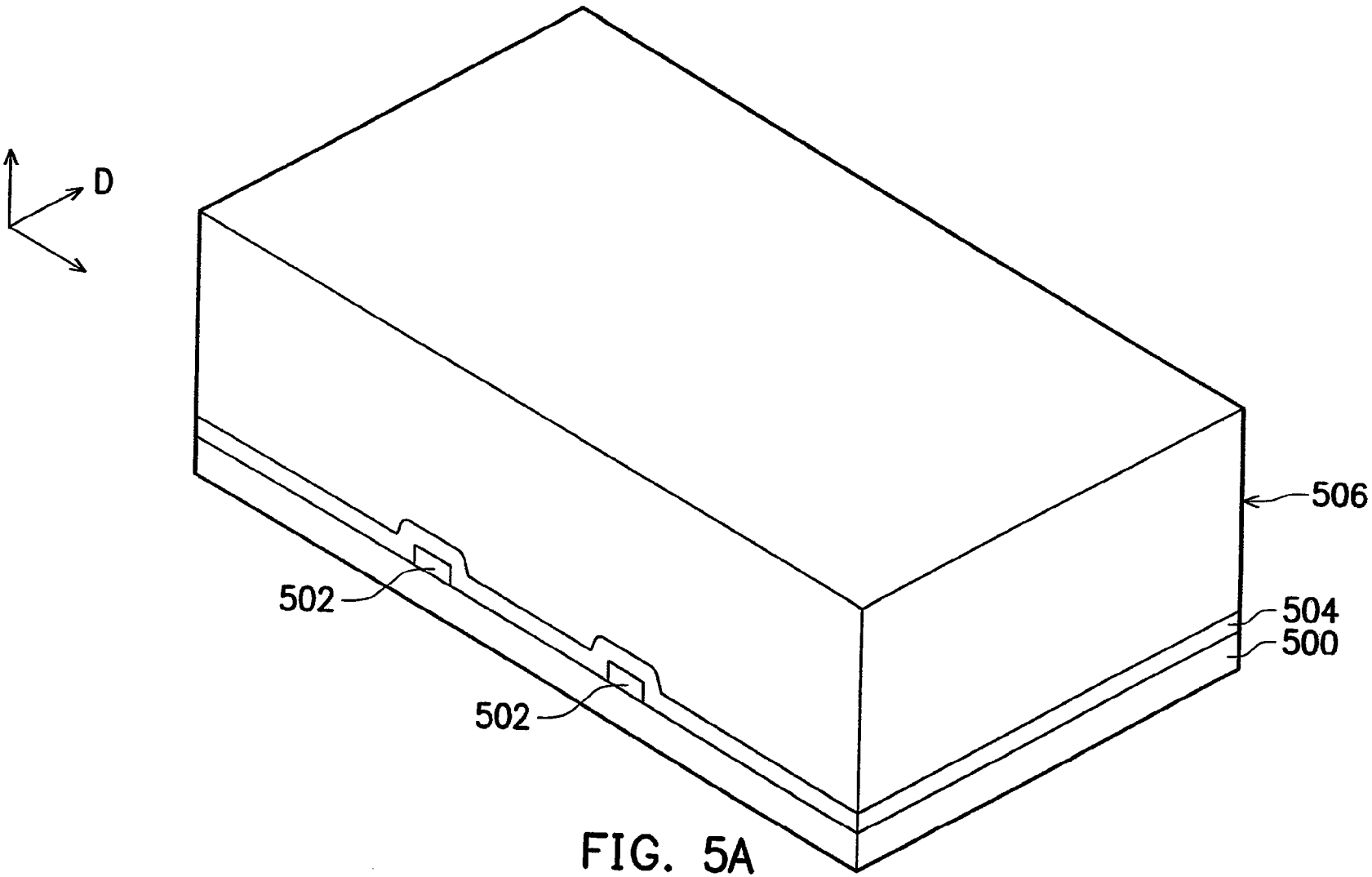
FIGS. 5A to 5C show 3-D cross-sectional flow charts of the third method of forming a partition wall structure.
Figure 5B:
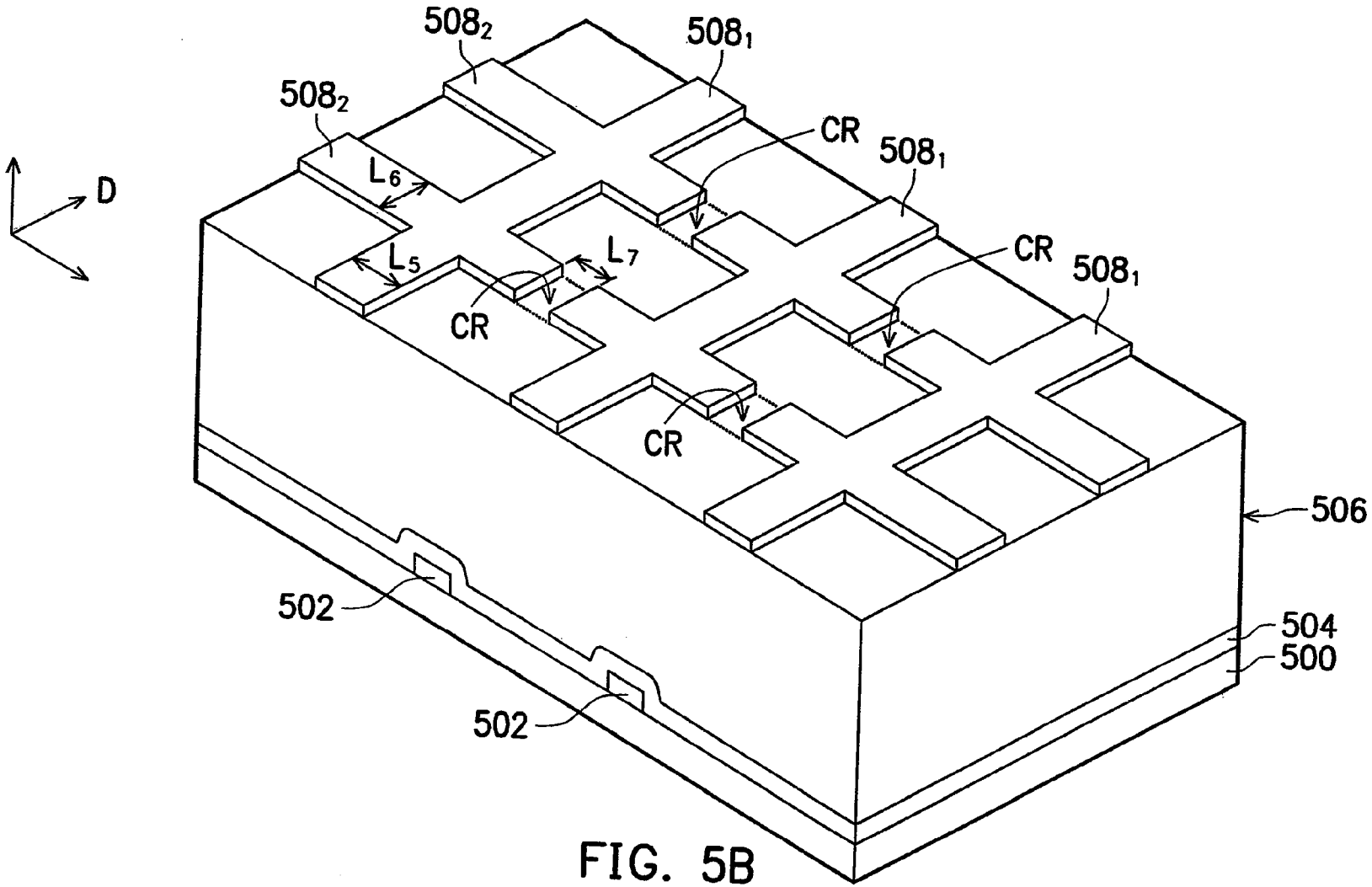
Figure 5C:
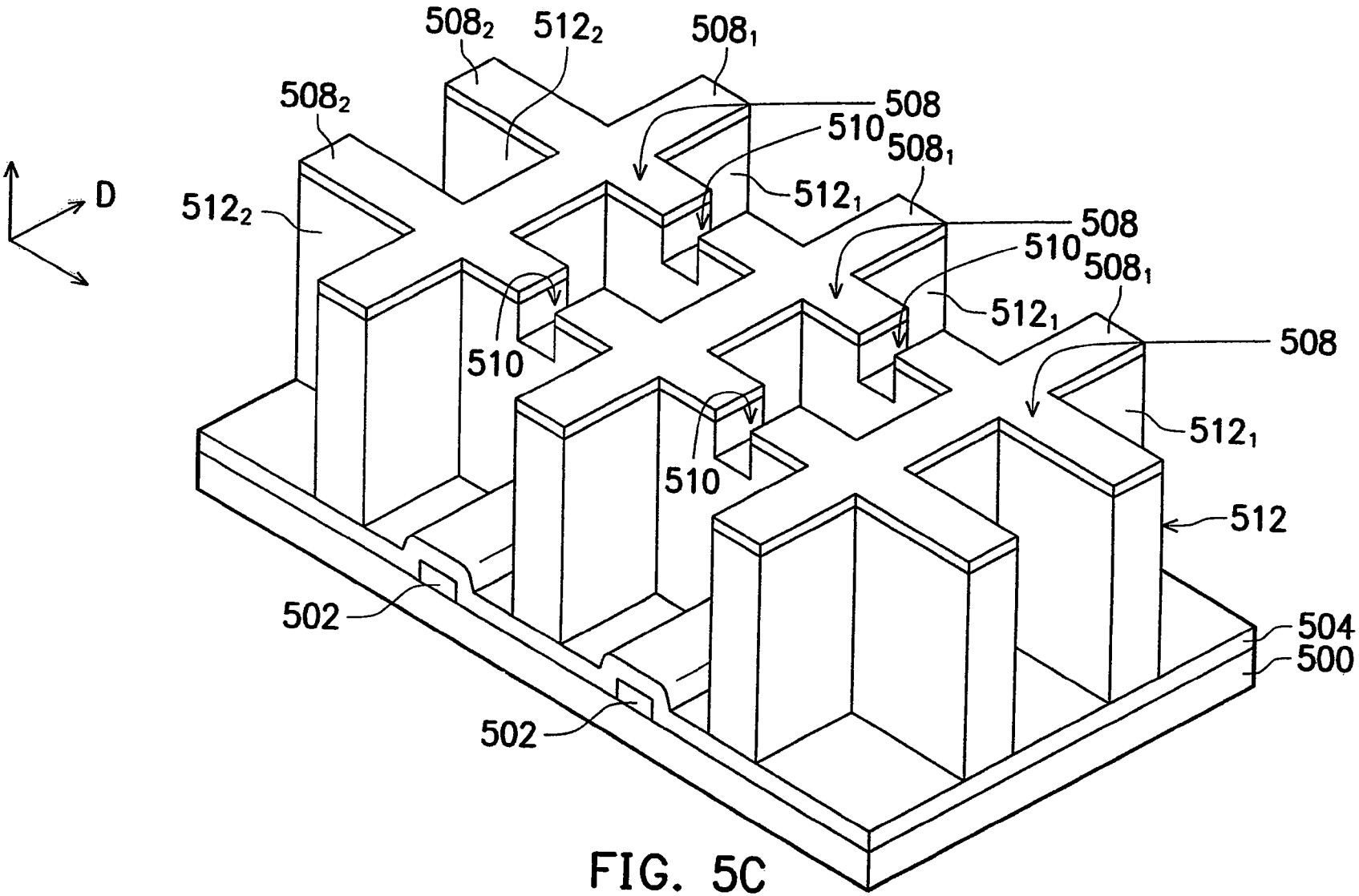

FIGS. 5A to 5C show 3-D cross-sectional flow charts of the third manufacturing method of forming partition wall structures according to the present invention.

First, a substrate 500 is provided. There forms a plurality of stripe electrodes 502 on the substrate 500. Each of the stripe electrodes 502 is parallel to a first direction (shown by arrow D). To simplify the description in this embodiment, only two stripe electrodes are shown.

An overcoat layer 504 is formed on the plurality of stripe electrodes 502 and substrate. Then shaping layer 506 is formed on the overcoat layer 504, as shown in FIG. 5A. In this embodiment, full print is used to print multi-layers (for example 7~8 layers) of paste on the overcoat to form shaping layer 506 after baking.

A dry photoresist layer is formed on the shaping layer 506.

The dry photoresist layer is exposed to form a shading mask 508 on the shaping layer 506. As shown in FIG. 5B, the shading mask 508 includes a plurality of first stripe ribs $\mathbf{508}_1$ and a plurality of second stripe ribs $\mathbf{508}_2$. Each of the first stripe ribs $\mathbf{508}_1$ is parallel to the first direction and is on the shaping layer 506 between every two stripe electrodes 502. Each of the second stripe ribs $\mathbf{508}_2$ is parallel to the second direction and is perpendicular to the first stripe ribs $\mathbf{508}_1$. Each of the second stripe ribs $\mathbf{508}_2$ forms a breaking rib CR between every two first stripe ribs $\mathbf{508}_1$.

Finally, sand blast process is performed to remove the shaping layer 506 which is not covered by the shading mask 508, exposing the overcoat layer 504 to form a partition wall structure 512 (includes a plurality of the first stripe wall $\mathbf{512}_1$ and a plurality of second stripe wall $\mathbf{512}_2$) as shown in FIG. 5C. Since the width $L_7$ of the breaking rib CR is smaller than the size of the grid-mesh-opening, the depth removed by the sand blast process is smaller than the depth removed in the grid-mesh-openings. Therefore, there is remaining shaping layer 506 in breaking rib CR. By the definition of the breaking rib CR, a cut 510 is formed on the rib.

According the method of the present invention, refer to FIGS. 5B and 5C, varying the width $L_5$ of the first stripe rib $\mathbf{508}_1$ and width $L_6$ of the second stripe rib $\mathbf{508}_2$, the size of grids of the rib 512 can be adjusted to obtain an adequate opening rate.

Furthermore, by varying the width $L_7$ of the breaking rib, the size of the width of the cut 510 may be adjusted.

[Fourth Method]

FIGS. 6A to 6D show the 3-D cross-sectional flow charts of the fourth manufacturing method of forming a partition wall structure according to the present invention.

First, a substrate 600 is provided. A plurality of stripe electrodes 602 form there on substrate 600. Each of the stripe electrodes is parallel to a first direction (shown by arrow D). To simplify the description in this embodiment, only two stripe electrodes are shown.

An overcoat layer 604 is formed on the stripe electrodes 602 and the substrate 600.

Figure 6A:
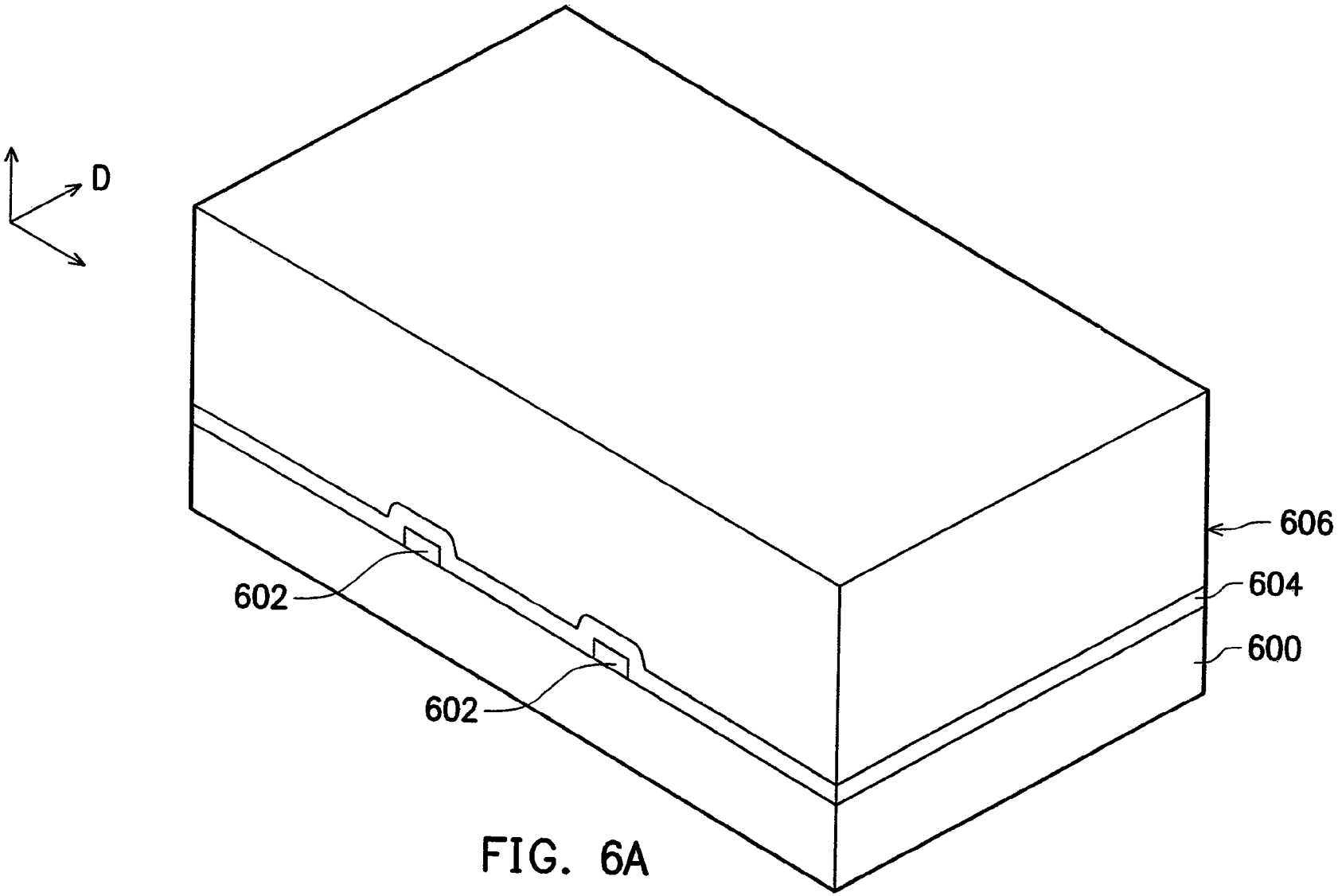
FIGS. 6A to 6D show 3-D cross-sectional flow charts of the fourth method of forming a partition wall structure.

A shaping layer 606 is formed on the overcoat layer 604, as shown in FIG. 6A. In this embodiment, a full print is used to print multi-layers (for example 7~8 layers) of paste on the overcoat layer 604 to form the shaping layer 606 after baking.

Figure 6B:
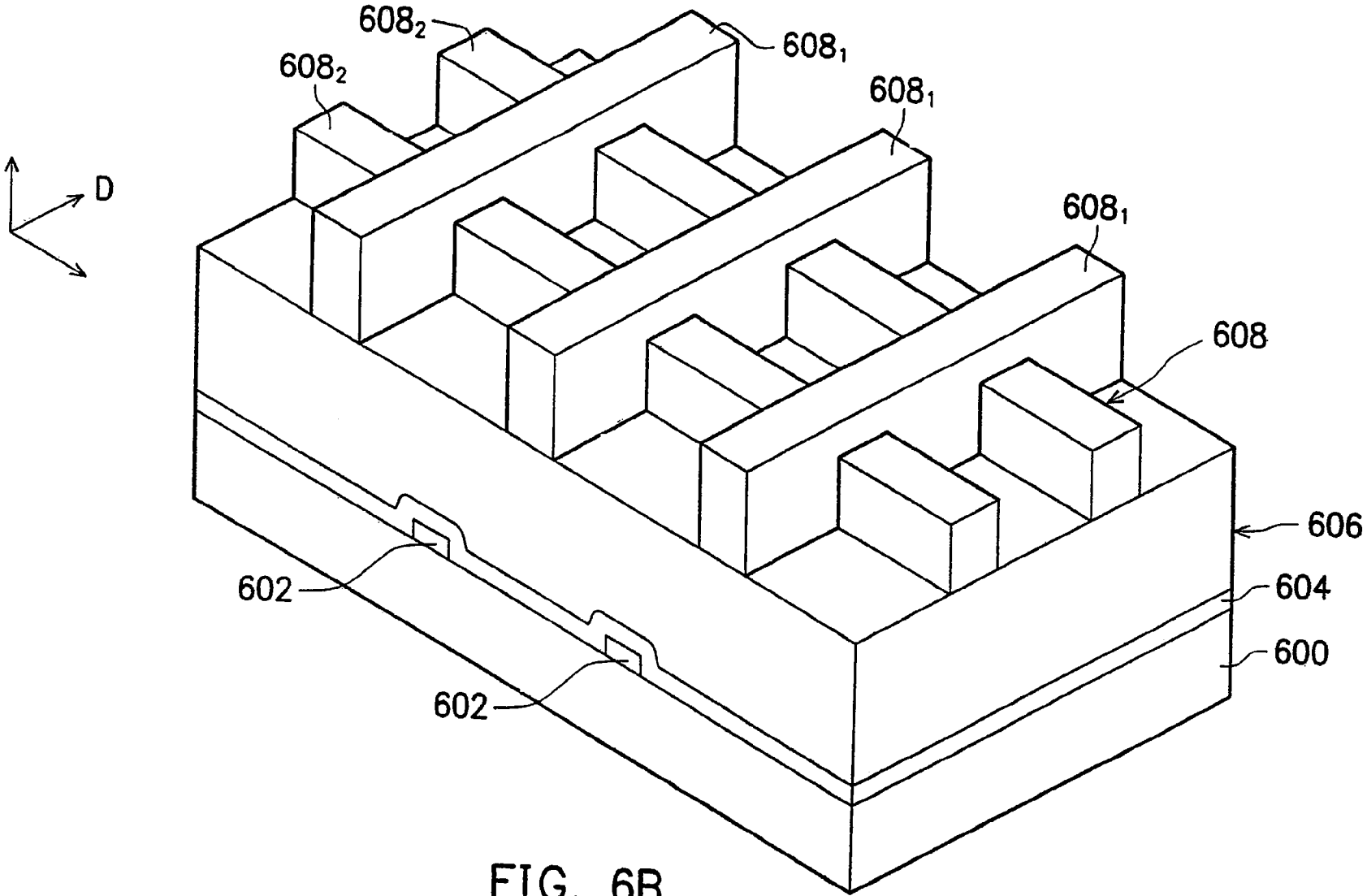

Next, grid-mesh-shaped photo-sensing shading layer 608 is formed on the shaping layer 606. As shown in FIG. 6B, the photo-sensing shading layer 608 includes a plurality of first stripe ribs $\mathbf{608}_1$ and a plurality of second stripe ribs $\mathbf{608}_2$.

Each of the first stripe ribs $\mathbf{608}_1$ is on the shaping layer 606 between every two stripe electrodes 602 and is parallel to the first direction. Each of the second stripe ribs $\mathbf{608}_2$ is parallel to a second direction and is substantially perpendicular to the first direction. The height of the first stripe ribs is larger than the height of the second stripe ribs.

The material of the photo-sensing layer 608 is constituted by the photo-sensing substance and paste. Furthermore, in this embodiment, the photo-sensing shading layer 608 may be made by the two following methods.

(1) First method: Pattern print is used to print multi-layers of grid-mesh-shaped photo-sensing shading layer on the shaping layer 606 to form the bottoms of the first stripe ribs $\mathbf{608}_1$ and the second stripe ribs $\mathbf{608}_2$. Pattern print is then used again to print a stripe-shaped second photo-sensing layer on the first photo-sensing shading layer along the first direction to form the top of the first stripe ribs $\mathbf{608}_1$ so as to form the photo-sensing shading layer as shown in FIG. 6B.

(2) Second method: Pattern print is used to print multi-layers of stripe-shaped photo-sensing shading layers on the shaping layer along the first direction to form the bottom of the first stripe rib $\mathbf{608}_1$. The pattern print is then used to print multi-layers of grid-mesh-shaped first photo-sensing shading layers on the second photo-sensing shading layer to form the photo-sensing shading layer 608 as shown in FIG. 6B.

Figure 6C:
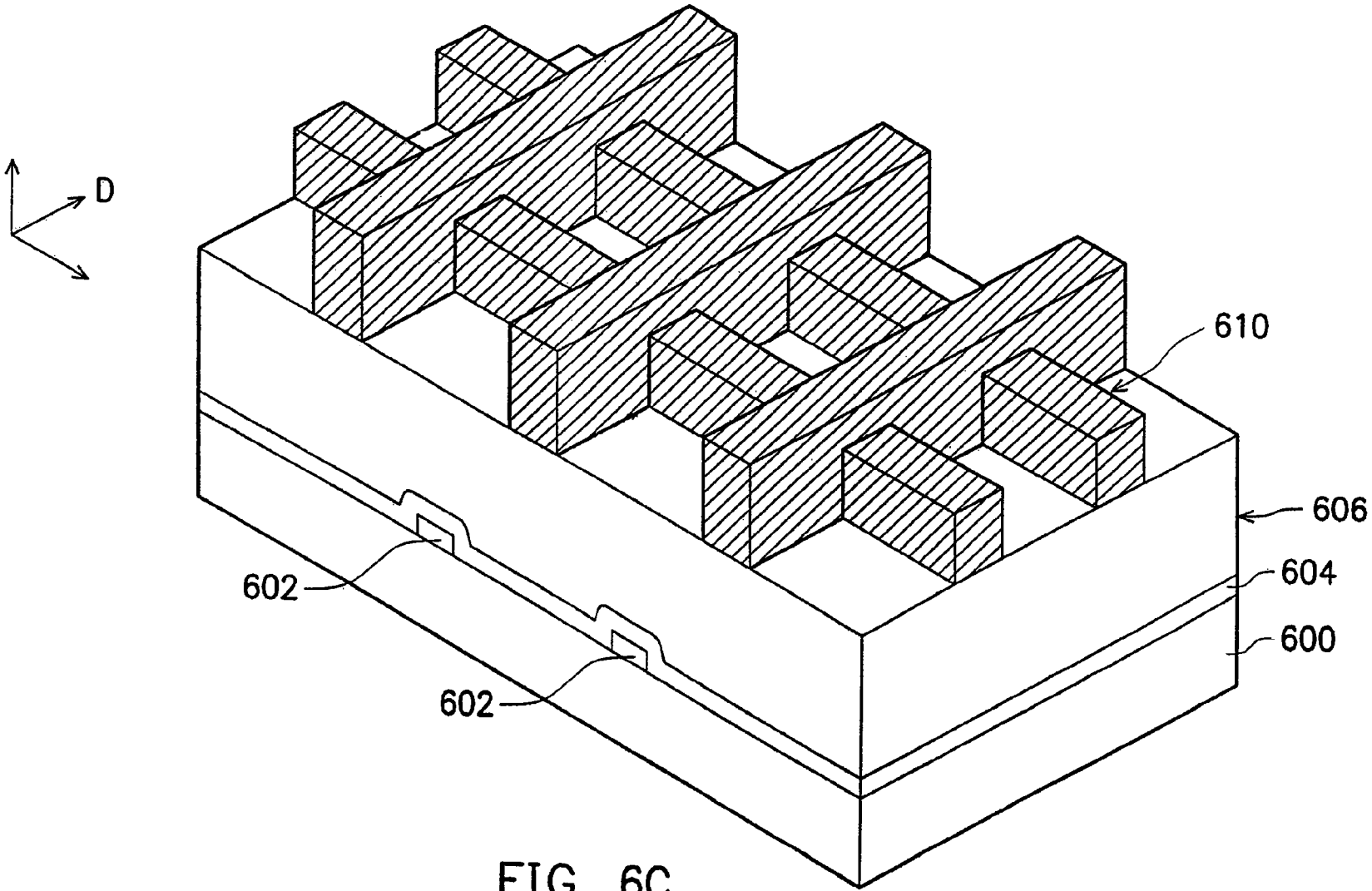

Next, the photo-sensing shading layer 608 is exposed to UV light to form the shading mask layer 610 on the shaping layer 606 as shown in FIG. 6C.

Figure 6D:
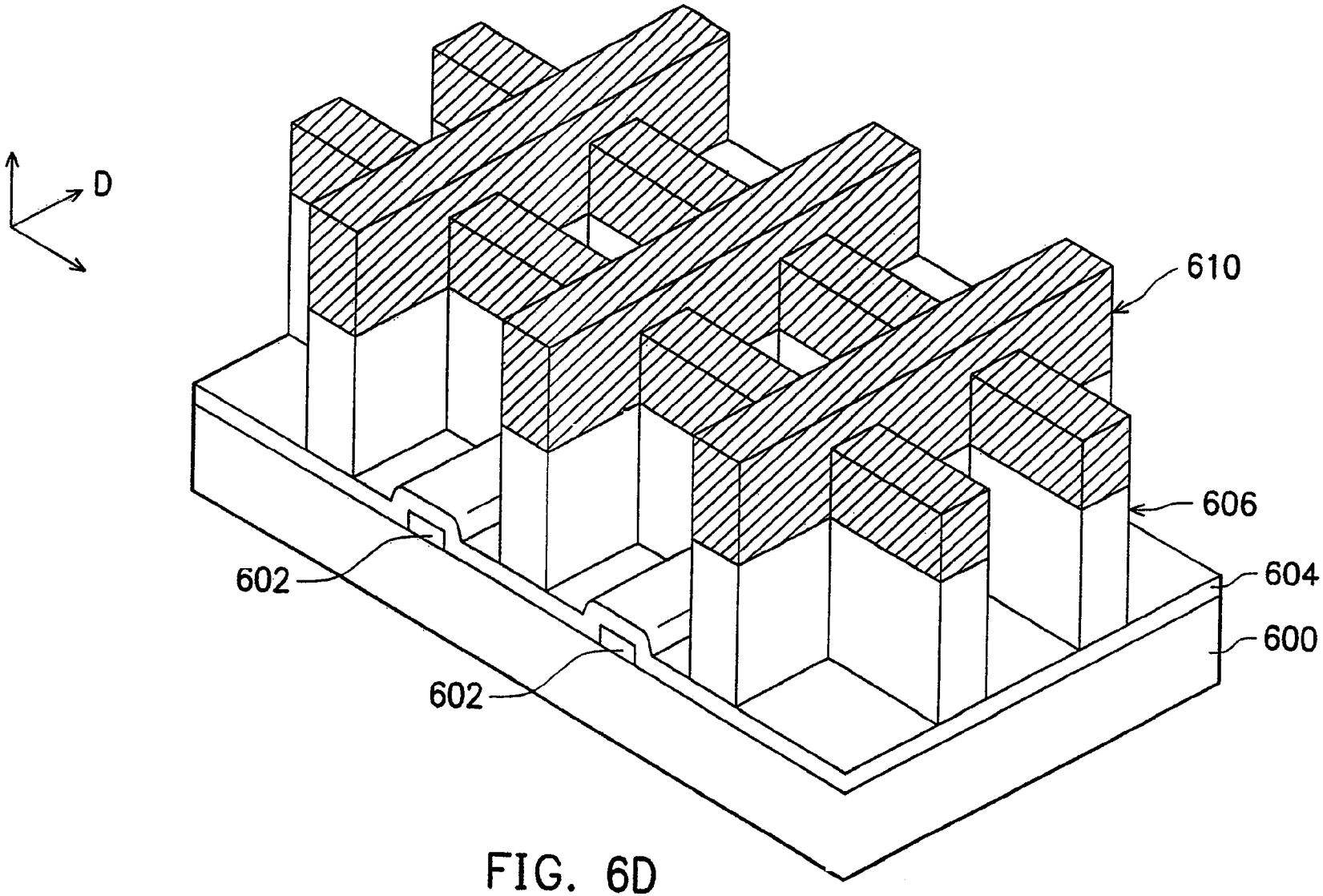

Finally, the sand blast process is performed to remove the shaping layer 606 which is not covered by the shading mask 610 to expose the overcoat 604 to form a partition wall structure as shown in FIG. 6D.

From the above four manufacturing methods for the rib, the present invention has the following advantages:

(1) The manufacturing process of the invention only produces ribs on the back substrate, so during the assembly, the alignment of the front and back substrate is easier than that disclosed by NEC.

(2) The opening rib of the rib can be easily adjusted to obtain a better opening rate and increases the coating rib of the fluorescent body, thereby obtaining better luminance.

(3) There are cuts on the ribs, so it is easy to perform the vacuum process and fill with gas during packing.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of manufacturing a partition wall structure on a plasma display panel having a first substrate, a plurality of stripe electrodes parallel to a first direction formed on the first substrate, and an overcoat layer on the stripe electrodes and the first substrate, comprising:

forming a shaping layer on the overcoat layer;

forming a dry photoresist layer on the shaping layer;

exposing the dry photoresist layer to form a shading mask on the shaping layer, the shading mask includes a plurality of first stripe ribs and a second stripe rib, wherein each of the first stripe ribs is parallel to the first direction and is on the shaping layer between every two stripe electrodes, the second stripe rib aligns along a second direction and is perpendicular to every first stripe rib, the second stripe rib crossing the stripe electrodes and having breaking cuts to expose the shaping layer, each breaking cut is between two adjacent first stripe ribs and a width of the breaking cut is smaller than a distance between two adjacent first stripe ribs;

performing a sand blast process to remove the shaping layer exposed to the shading mask to expose the overcoat layer and form the partition wall structure; and leaving remaining shaping layer in each of the breaking cuts after the sand blast process.

2. The method as claimed in claim 1, wherein the shaping layer is formed by using solid print to print multi-layers of paste on the overcoat layer after baking.

3. The method as claimed in claim 1, comprising:

providing a second substrate having an air-pump hole, parallel to the first substrate, forming a discharging space between the first substrate and the second substrate, wherein the discharging space connects to the air-pump hole.

4. The method as claimed in claim 1, wherein the shaping layer in each of the breaking cuts is at least partially over said plurality of stripe electrodes.

5. The method as claimed in claim 4, wherein the shaping layer is formed by using solid print to print multi-layers of paste on the overcoat layer after baking.

6. The method as claimed in claim 4, comprising:

providing a second substrate having an air-pump hole, parallel to the first substrate, forming a discharging space between the first substrate and the second substrate, wherein the discharging space connects to the air-pump hole.

7. A method of manufacturing a partition wall structure on a plasma display panel having a first substrate, a plurality of stripe electrodes parallel to a first direction formed on the first substrate, and an overcoat layer on the stripe electrodes and the first substrate, comprising:

forming a shaping layer on the overcoat layer;

forming a dry photoresist layer on the shaping layer;

exposing the dry photoresist layer to form a shading mask on the shaping layer, the shading mask includes a plurality of first stripe ribs and a second stripe rib, wherein each of the first stripe ribs is parallel to the first direction and is on the shaping layer between every two stripe electrodes, the second stripe rib aligns along a second direction and is perpendicular to every first stripe rib, the second stripe rib crosses the stripe electrodes and has breaking cuts to expose the shaping layer, and each breaking cut is between two adjacent first stripe ribs;

performing a sand blast process to remove the shaping layer exposed to the shading mask to expose the overcoat layer and form the partition wall structure; and leaving remaining shaping layer in each of the breaking ribs after the sand blast process.

* * * * *